US005727267A

United States Patent [19]

Keilhauer

[11] Patent Number: 5,727,267

[45] Date of Patent: Mar. 17, 1998

[54] THERAPEUTIC SLEEPING PILLOW

[76] Inventor: Ed Keilhauer, 400 Finchdene Sq., Unit 11, Scarborough, Ontario, Canada, M1X 1E2

[21] Appl. No.: 711,216

[22] Filed: Sep. 9, 1996

Related U.S. Application Data

[60] Provisional application No. 60/003,642 Sep. 15, 1995.

[51] Int. Cl.[6] ..... A47G 9/00

[52] U.S. Cl. ..... 5/636; 5/632

[58] Field of Search ..... 5/630, 632, 636, 5/640

[56] References Cited

U.S. PATENT DOCUMENTS

| | | | |
|---|---|---|---|
| 2,521,780 | 9/1950 | Dodd | 5/636 X |
| 2,700,779 | 2/1955 | Tolkowsky | 5/338 |
| 3,829,917 | 8/1974 | Delaittre | 5/338 |
| 4,218,792 | 8/1980 | Kogan | 5/636 |
| 4,424,599 | 1/1984 | Hannouche | 5/632 |
| 4,550,458 | 11/1985 | Fiore | 5/640 X |
| 4,821,355 | 4/1989 | Burkhardt | 5/434 |
| 4,908,894 | 3/1990 | Sanders | 5/640 |
| 5,123,132 | 6/1992 | Dixon | 5/636 |

FOREIGN PATENT DOCUMENTS 9213821 12/1992 Germany .

OTHER PUBLICATIONS

PCT Publication WO 89/10714, Rodgers, 2 May 1989, Pillow.

PCT Int'l Search Report, PCT/CA96/00608, Keilhauer, 20 Oct. 1996, Therapeutic Sleeping Pillow.

*Primary Examiner*—Michael F. Trettel

*Attorney, Agent, or Firm*—Oldham & Oldham Co., L.P.A.

[57] ABSTRACT

A therapeutic sleeping pillow for a user is generally rectangular with longer front and rear edges and a pair of shorter side edges and upper and lower surfaces. A central portion of the upper surface is provided with a cavity for receiving the user's head, with a neck-supporting ridge formed between the front edge of the pillow and the cavity in the central portion. A wedge-shaped extension of the pillow projects from the front edge to support the upper back of the user. At least one of the pair of shorter side edges has an extension disposed thereon. Each such side extension is provided with a relatively shallow central cavity on the upper surface for receiving and supporting the user's head and a front edge for supporting the user's neck. The upper surface of each such side extension slopes generally downwardly from the front edge towards the rear edge.

13 Claims, 2 Drawing Sheets

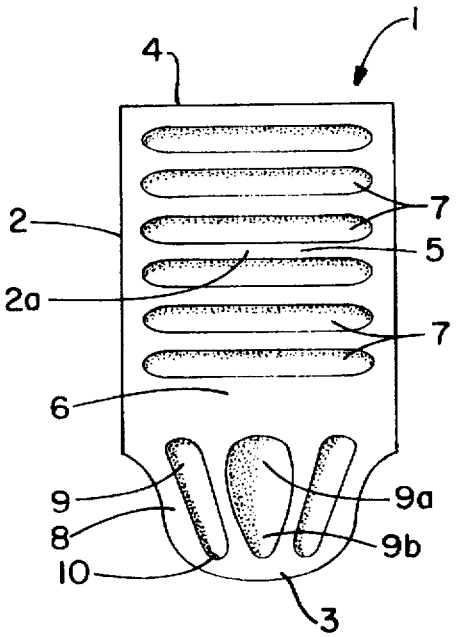
FIG.-1
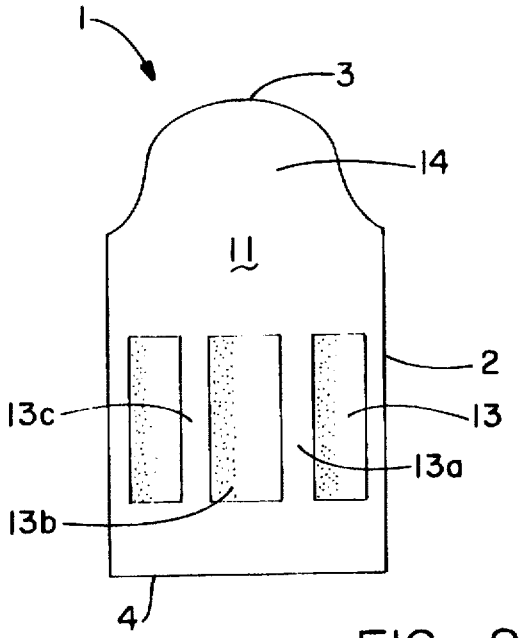
FIG.-2
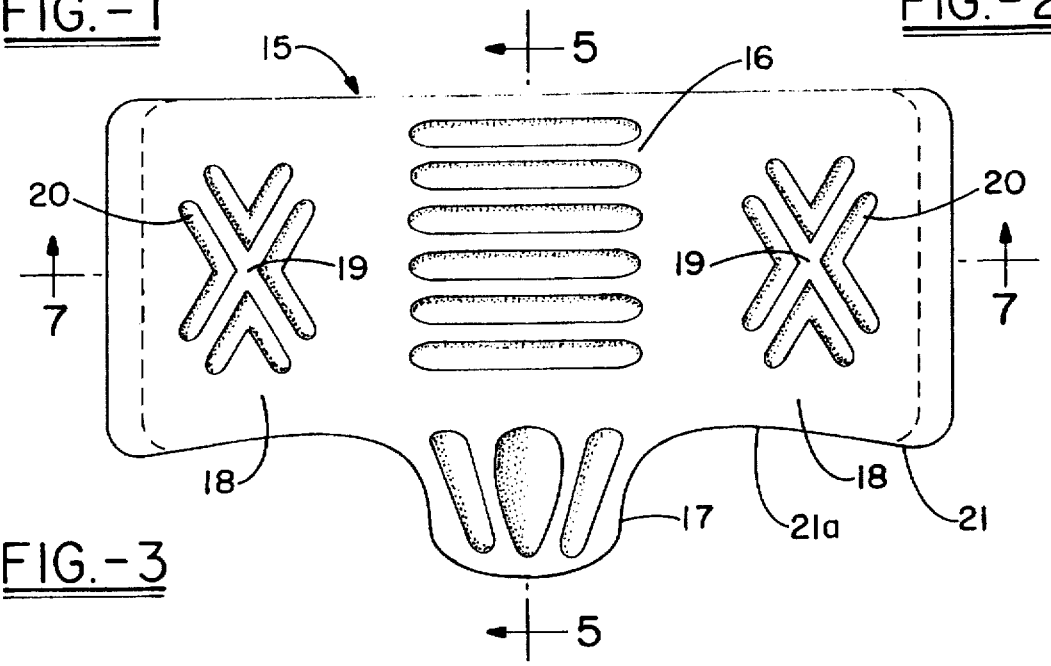
FIG.-3
FIG.-4
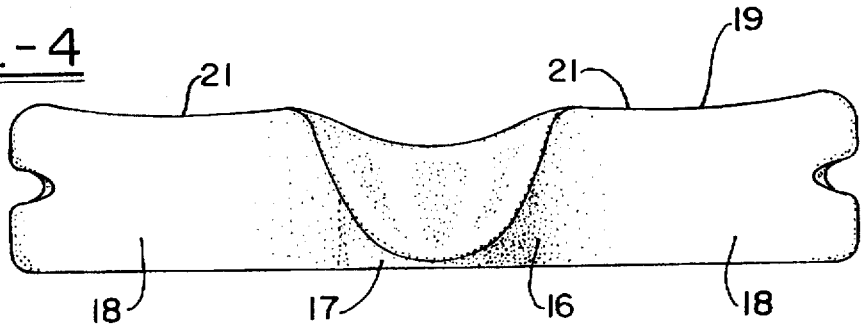

THERAPEUTIC SLEEPING PILLOW

This application claims the benefit of Provisional Application No. 60/003,642, filed Sep. 15, 1995, now abandoned.

BACKGROUND OF THE INVENTION

1. Field of the Invention

The present invention relates to a therapeutic pillow that is adapted to provide support to the head, neck and upper back of the user in a horizontal resting position, and more particularly relates to such pillows that are adapted to provide proper support to the head, neck and upper back of the user, both when the user is sleeping on his or her back, and when the user is sleeping on his or her side.

2. Description of the Prior Art

One of the objects of a well designed pillow is to support and maintain the neck and head of the user in substantially the same position relative to the body as when the user is standing or siring. Many conventional pillows consist of fabric enclosures filled with feathers, down or chipped foam, and may be shaped by the user to provide reasonably adequate support for the user while the user falls asleep.

However, many people suffer from an uncomfortable night's sleep because of inadequate support provided to their neck and upper back by these conventional pillows. Chronic neck pain or stiffness and a tense upper back often result from insufficient support of the neck and upper back from the pillows during sleep. This pain or stiffness is believed to be the result of having the head or neck held in an incorrect position during sleep. Although such pillows can be shaped to provide comfortable support in the position in which the users fall asleep, these pillows do not retain that shape, however, and do not provide the desired support throughout the entire sleeping period. This problem is exacerbated by movement of the user during sleep.

Furthermore, it appears to be important to apply gentle but relatively uniform forces to the head and neck region to support the head, spine and neck muscles of the user, which assists in preventing or reducing neck and spinal stresses and in inducing more restful sleep.

One approach to improve the support of the sleeper's head over that of conventional pillows has been the use of a form retaining pillow, which may be made of resilient foam, often manufactured with a concave cavity extending along the entire center section of the pillow. The sides of such pillows have heretofore been moulded to be thicker than the center of the pillow, although in some cases, the center cavity has been formed by removing foam from the center of a moulded pillow.

The concave cavity allows the sleeper's head to be supported in the center of the cavity, at the desired level, anywhere along the length of the pillow. The longitudinal edges of the pillow are higher above the mattress or other sleeping surface than the center of the pillow and provide support to the neck of the sleeper from the middle of the neck to the head.

In some instances, each side of such a pillow has been made to be of different height than the other, thus providing the user with two different heights to accommodate the juncture between the neck and head, although this requires the user to turn the pillow around to achieve the benefit of the different elevations. It is also known to manufacture such moulded pillows with inserts in the center cavity to provide a softer support for the user's head than foam alone, or with inserts in the longitudinal edges to modify the resilience of the foam, for example, to make one side of the pillow firmer than the other.

It is generally intended in the design of these pillows of the prior art that the spine is supported in a generally straight line when the sleeper is lying on his or her back, or on his or her side. However, there are shortcomings with each of the designs of the prior art that make them ineffective in providing support through a wide range of sleeping positions and habits, and that are intended to be overcome by the pillow of the present invention.

Such moulded pillows of the prior art are intended to be used for a wider range of users, and for both side and back sleeping. This has necessarily involved some compromise in the design of these pillows, as such pillows must be designed to be comfortable in almost any position in which they may be used.

Such pillows are commonly designed to support the neck of the user while the user is lying on his or her back, but do not provide adequate support for the upper back in that position. Furthermore, when the user is resting in the side position, these pillows do not provide sufficient support for proper alignment of the spine, as the sleeper's head and neck must be supported at a greater distance from the mattress or other sleeping surface, than when the sleeper is lying on his or her back, and the pillow edges are too low to provide the necessary support. It is important to maintain proper alignment of the user's spine during sleep and there are different support requirements for back and side sleeping positions.

One example of such a prior art pillow is disclosed in U.S. Pat. No. 4,218,792, which discloses an orthopedic pillow intended to support the head and neck of a user. That pillow, however, suffers from a number of defects which are overcome by the pillow of the present invention. For example, the pillow disclosed in the aforementioned U.S. Patent has one central concavity which is adapted to support the head of the user whether the user is lying on his or her back or side, and a protruding boss which is adapted to support only the cervical vertebrae in either position. Furthermore, the pillow of the prior art slopes upwardly from its front to back edge, failing to account for the distortion of the mattress of other sleeping surface by the shoulder of the user.

SUMMARY OF THE INVENTION

The present invention provides a therapeutic pillow with enhanced ability to support the head, neck and upper back of the user when the user is sleeping either on his or her back or side positions, referred to in this disclosure as the back sleeping and side sleeping positions, respectively.

In particular, the present invention provides a therapeutic pillow with enhanced ability to support the head, neck and upper back and, in one embodiment provides, a generally rectangular shaped section of a suitable resilient form-retaining material, having a centrally disposed cavity in its upper surface which cavity is adapted to support the head of the sleeper. The cavity merges with the forward edge of the pillow and through a smooth arcuate neck supporting section into a generally wedge shaped extension or boss which extends substantially beyond the front edge of the pillow and which is adapted to support the upper back of the user.

In this first embodiment, the rectangular shaped section has a concave upper surface bounded by rounded edges that is adapted to conform generally to the shape of the user's head. The center portion of this concave section is the thinnest point of the pillow, and is adapted to hold the sleeper's head at a distance from the mattress to maintain the spine in a generally aligned position during sleep.

Unlike some of the pillows of the prior art which provide a concave, front to back surface creating a uniform cavity along the length of the pillow, the pillow of the present invention provides a relatively deep central concavity in form of a centrally located, generally bowl-shaped cavity to provide full, comfortable support for the user's head. (In this disclosure, the width of the pillow refers to the dimension generally parallel to that of the user's body, and length refers to that dimension generally perpendicular to the user's body). The rear end of the cavity, ie., the end of the cavity adjacent to the top of the use's head forms a concave surface along the rear edge of the pillow to provide the desired degree of support at that edge. The front edge of the cavity, ie., the edge adjacent to the user's neck is concave along the lower edge of the pillow, and convex across the front edge of the pillow, to provide support along the neck of the user. This neck supporting front edge of the front merges smoothly with a generally wedge-shaped extension that extends from the front side of the pillow to provide support for the upper back of the user.

In another embodiment of the invention, the therapeutic pillow includes a rectangularly-shaped center section of resilient form-retaining material, as described above, having the same deep concavity in the upper surface and merging through a smooth arcuate neck supporting section into a generally wedge shaped extension that supports the upper back of the user. On either side of the center section are generally rectangular left and right side sections, which are provided with slightly concave upper surfaces, adapted to receive and support the side of the user's head which merge smoothly into the center section. The center of each of the concave upper surfaces of the side sections is significantly higher than the center of the center section. The side extensions are, as stated, intended to support the head and neck of the user in a side sleeping position and thus, are generally thicker at their respective centers than is the center section. Consequently, when the sleeper is on his or her side, the side extensions of the pillow raise the head of the user to a higher level to accommodate the user's shoulder and to allow the user to sleep comfortably in the side position. The edges of both side extensions facing the sleeper may be undercut to permit the user's shoulder to extend slightly underneath the upper surface of the side section, and the upper surface of the pillow's side extensions supports the head and neck of the user when side sleeping.

Each of the side portions of the pillow of the present invention have an overall downwardly slope from the front edge to the rear edge of the pillow. This compensates for the lowering of the front edge of the pillow resulting from the weight of the user's shoulder on the mattress or other sleeping surface, and assists in maintaining the proper alignment of the head, neck and spine of the user.

The upper surfaces of each of the center and side sections, including the wedge-shaped extension, may be slightly grooved to improve the comfort of the user and to improve air circulation under the head of the user.

In either of the two embodiments described above, the lower surface of the pillows may be provided with channels or grooves to reduce the thickness of the foam at desired locations, and to improve the distribution of forces over the surface of the pillow, thus distributing the supporting forces more uniformly over the head and neck of the user. This provides a pillow with, when in use, a general uniform firmness over the entire surface of the pillow in contact with the head, neck and back of the user.

In a preferred embodiment of the invention, the therapeutic pillow may be made entirely of high resilience polyurethane foam. The therapeutic pillow may be formed by means of conventional moulding processes, and in addition, may provide the desired density and stability to the foam. The proportions of the components of the polyurethane are selected and blended to provide a cured foam, which is preferably a cold cured foam, pillow having the desired degree of resilience. Although polyurethane foam is the preferred material for the pillow of the present invention, any resilient form retaining material providing suitable comfort to the user may be used.

The pillow of this embodiment may contain lateral grooves along its side edges to provide a softer side edge for the side of the user's face.

BRIEF DESCRIPTION OF THE DRAWINGS

FIG. 1 is a plan view of the upper surface of a first preferred embodiment of a therapeutic pillow according to the present invention;

FIG. 2 is a plan view of the lower surface of the first preferred embodiment of a therapeutic pillow according to the present invention;

FIG. 3 is a plan view of the upper surface of a second preferred embodiment of a therapeutic pillow according to the present invention;

FIG. 4 is a front elevation view of the second preferred embodiment of a therapeutic pillow according to the present invention;

DETAILED DESCRIPTION OF THE INVENTION

Figure 5:
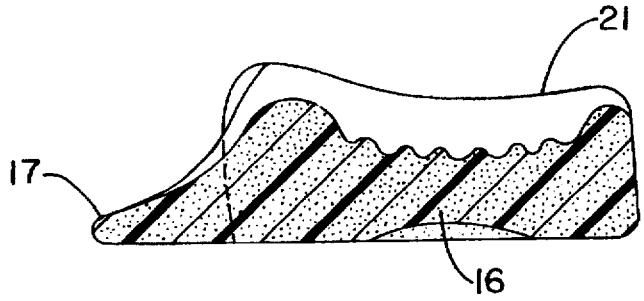
FIG. 5 is a sectional view taken along line 5—5 in FIGS. 1 and 3.

Referring to the first preferred embodiment of the invention as shown in FIGS. 1 and 2, there is shown in FIG. 1 a therapeutic pillow generally designated 1 with enhanced ability to support not only the head and neck of the user, but the upper back as well while the user is sleeping on his or her back. In this embodiment, the pillow of the present invention, as seen from the top, is a generally rectangularly-shaped section 2 of resilient, form-retaining material. Centrally located on the upper surface having a relatively deep concavity centrally disposed on its upper surface 2*a* and merging through a smooth arcuate neck supporting ridge 2*b* (Shown in FIG. 5) into a generally wedge shaped extension 3 which supports the upper back of the user.

Referring first to FIG. 1, the therapeutic pillow 1 comprises a major portion 2 having a generally rectangular horizontal cross-section and a concave upper surface 2*a*, which is integrally moulded with a minor portion wedge-shaped extension or boss 3. The deep concave upper surface 2*a* is intended to conform to the shape of the user's head, and is shaped to provide generally uniform support for the user's head when the user is sleeping on his or her back.

As may be seen in the drawing of the second preferred embodiment in FIG. 4, the top edge 4 of the center section is less concave than the center 5 of the concave upper surface of the rectangular shaped section. The upper front edge 6 of the rectangular shaped section may be slightly concave and is integrally moulded with the wedge extension 3 to provide a smooth transaction between the centrally located concavity 2*a* and the wedge-shaped extension, and to provide support for the cervical vertebrae of the user. The upper surface 2a may have ridges or channels 7 running along its concave surface to enhance circulation of air between the surface of the pillow and any covering placed on it.

The wedge-shaped extension 3 may have ridges or channels 9 running longitudinally down the upper surface 8 of the wedge extension 3. The crests of the ridges or channels 9 may be higher at the top of the wedge extension 3 than at its lower, forward end to improve the support of the upper neck of the user. The crests of the ridges or channels 9 at the bottom 10 of the wedge extension 3 may be tapered to enhance the support of the lower neck and the upper back. The center crest of the grooves 9a may be sharply tapered to provide a small cavity at the midpoint of the center groove 9b, adapted to accommodate the slight protrusion of the vertebrae at the top of the user's back.

As can be seen in FIG. 2, the bottom surface 11 of the pillow 1 may contain shallow grooves or channels 13 that assist in the circulation of air between the pillow and any pillow cover used with it, and that may effectively reduce the thickness of the foam above the channel, thus increasing softness of the therapeutic pillow 1 when the back of the head is placed in the center of the deep concave portion of the rectangular shaped section 5. The locations and sizes of the channels 13 may be selected to provide a pillow with a generally uniform degree of softness over the entire surface of the pillow or to provide generally uniform support to the head and neck of the user. The crests of the channels 13a may be higher at the top of the channels 13b and may gradually taper down to their lowest points at the mid-point of the length of the channel 13c. The bottom of the wedge extension 14 may be solid as shown in FIG. 2 and may have a generally smooth surface.

Referring to a second embodiment of the invention as shown in FIGS. 3 to 7, there is shown in FIG. 3 a therapeutic pillow generally designated as 15 with an enhanced ability to support the head and neck, as well as the upper back of the user. In this embodiment, the invention comprises a generally rectangular shaped section 16 integrally moulded and smoothly merging with a generally wedge shaped extension 17. The rectangular shaped section 16 may be the center section of the therapeutic pillow, as shown in FIG. 3, and may be integrally moulded on each longitudinal side with a generally rectangular side section 18.

Referring first to FIG. 3, the therapeutic pillow 15 includes a generally rectangular shaped section 16 which is integrally moulded with a generally wedge shaped extension or boss 17 as described with respect to the first preferred embodiment. The wedge extension or boss 3 in both this embodiment and in the embodiment of FIGS. 1 and 2 extends substantially beyond a line drawn between the from comers of the pillow to provide support not only to the neck but the upper back of the user. The rectangular center section 16 may have integrally moulded on each of its left and right sides, a rectangular side section 18. The upper surface 19 of each of the side sections 18 may be slightly concave in their respective centers to conform to the shape of, and uniformly support, the head and the neck of the user when he or she is sleeping on his or her left or fight side. The rectangular side sections 18 are greater in height than the rectangular center section 16 to accommodate height of the user's shoulder when the user is on his or her side, and to permit the user to lay comfortably in a side position. This assists in providing proper alignment of the spine in the side sleeping position.

As noted above, and as shown in more detail in FIG. 5, the upper surfaces 19 have a general downwards slope from the front to the rear of the pillow to compensate for any depression or deformation of the mattress or other sleeping surface on which the pillow rests resulting from the weight of the user's shoulder. Such a depression or deformation would normally result in a lowering of the front edge of the pillow; the front to rear downward slope of the pillow's side sections 18 is intended to maintain the head, neck and spine of the user in proper alignment when sleeping.

The upper surface on both side sections may have U-shaped grooves or channels 20 to permit air circulation across the surface of the therapeutic pillow 15. The from edges 21 a of both side sections may be slightly under-cut to provide room and support for the shoulder when the user rests on either the left or right side.

Figure 6:
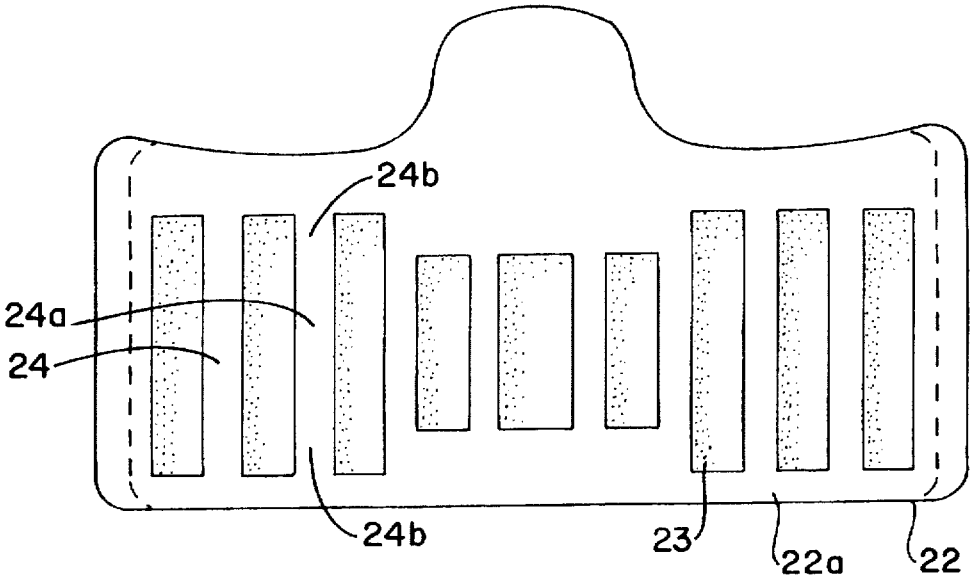
FIG. 6 is a plan view of the lower surface of the second preferred embodiment of a therapeutic pillow according to the present invention.
Figure 7:
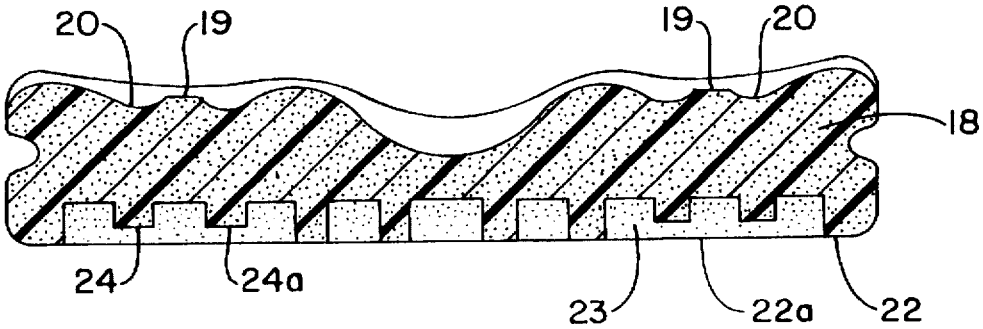
FIG. 7 is a sectional view taken along line 7—7 in FIG. 3.

As best seen in FIG. 6, the bottom of the therapeutic pillow 22 may include ridges or channels 23 which are intended to provide more uniform softness across the surface of the pillow. The crests 24 of the channels 23 may be highest at the mid-point of the length of the channels 24a on the side sections. The crests may taper gradually on either side of the mid-points 24b, to provide extra softness for the head when the user is sleeping on his or her side.

The therapeutic pillow 1 and 15 may be made from high resilience polyurethane foam. The components of the foam may be selected to provide the desired degree of resilience in the foam once the moulding process is completed. The selection of the components of the foam is within the competence of those skilled in that art, may contribute to the ability to mold the pillow 1 and 15 successfully, and may contribute to the ease of cleaning the pillow 1 and 15. The resilience of the foam provides the support and comfort for the head, neck and upper back of the user when sleeping in the back or side positions. The method used for the moulding and cold curing processes are both well known in the art.

The ridges or channels 8 and 20 in both embodiments may facilitate air flow or circulation across the surface of the therapeutic pillows 1 and 15 when in use. The ridges or channels 8 and 20 may facilitate the smooth appearance of the surface of the pillows 1 and 15 when covered with a pillow case or other casing.

In practice, the user of the therapeutic pillow in the first preferred embodiment will place the back of his or her head in the deep concave portion of the rectangular shaped section 5. The wedge-shaped extension 3, and more specifically the crests of the ridge between the deep concavity and the wedge shaped section 9 will support the junction between the user's neck and head, while the downward extension of the wedge provides support for the upper back of the user. In the second preferred embodiment, the user will have the option to utilize the therapeutic pillow as described for the first embodiment, or the user will be able to place the side of the head on either of the side sections 18. The side sections 18 are elevated in height to allow for the comfortable placement of the shoulder at the under-cut of the front upper edge of the side section 21a when resting on either the fight or the left side.

The nature of the pillow and its use are such that the user's head, neck and upper back are supported at all times when resting on either the side or the back positions. In practice, the use of the therapeutic pillow allows for more relaxed and restful side and back sleeping positions. By providing both a contoured center section that provides support for the head and neck and upper back of the sleeper when sleeping on his or her back, in combination with side sections that support the head and neck of the sleeper at a higher elevation when the sleeper is sleeping on his or her side, the pillow of the present invention overcomes many of the problems associated with pillows of the prior art.

The pillow of the present invention may be manufactured in a range of sizes to compensate for varying sizes of users. The thickness of the pillow may be modified to compensate for different user shoulder sizes, and the thickness of the center section adjusted to provide for proper lift of the neck and head of the user.

What is claimed is:

1. An orthopedic pillow of generally rectangular configuration having two longer sides and two relatively shorter sides comprising:

a center portion having a centrally disposed relatively deep cavity on an upper surface adapted to receive and support the rear of a user's head;

a neck-supporting ridge formed on a front edge of said pillow, said ridge merging smoothly with said cavity and being concave along the length of the pillow and convex across the front edge of said pillow;

a wedge shaped extension merging smoothly with said front edge and projecting forwardly from the front edge of said pillow to support the upper back of said user;

at least one side extension disposed on at least one of the two sides of said center portion;

each said side extension having a generally centrally disposed relatively shallow cavity on an upper surface adapted to receive and support the user's head, and a front edge adapted to support the user's neck; and the upper surface of each said side extension sloping generally downwardly from the front to the rear of the pillow.

2. The pillow according to claim 1 in which at least one of the center and side portions have shallow channels or depressions formed therein.

3. The pillow according to claim 1 in which a bottom surface of the pillow has shallow channels or depressions formed therein.

4. The pillow according to claim 1, further comprising a lateral groove in at least one of said side extensions.

5. The pillow according to claim 4 in which said lateral groove is in the side opposite said center section.

6. An orthopedic pillow of generally rectangular configuration having pair of parallel side edges and front and rear edges defined by connecting the ends of the side edges, said pillow comprising:

a centrally disposed cavity on an upper surface adapted to receive and support the rear of a user's head;

a neck-supporting ridge formed on a front edge of said pillow, said ridge merging smoothly with said cavity and being concave along the length of the pillow and convex across the front edge of said pillow;

a wedge shaped extension merging smoothly with said ridge and projecting forwardly outward therefrom beyond the front edge of said pillow.

7. The pillow according to claim 5 in which said centrally disposed cavity has shallow channels or depressions formed therein.

8. The pillow according to claim 5 in which a bottom surface of the pillow has shallow channels or depressions formed therein.

9. The pillow according to claim 6 in which the upper surface has shallow channels or depressions formed therein.

10. The pillow according to claim 6 in which a bottom surface of the pillow has shallow channels or depressions formed therein.

11. The pillow according to claim 6, further comprising at least one side extension disposed on at least one of the two sides of said center portion, each said side extension having a generally centrally disposed shallow cavity on the upper surface adapted to receive and support the user's head.

12. The pillow according to claim 6, further comprising at least one side extension disposed on at least one of the two sides of the center portion, the front edge of each said side extension adapted to receive and support the user's neck.

13. The pillow according to claim 6, further comprising at least one side extension disposed on at least one of the two sides of the center portion, each said side extension sloping generally downwardly from the front to the rear of the pillow.

* * * * *